US005900692A

United States Patent [19]

Jung et al.

[11] Patent Number: 5,900,692

[45] Date of Patent: May 4, 1999

[54] INDIRECT CATHODE SLEEVE

[75] Inventors: Gil Young Jung; Kyeong Sang Lee; Gong Seok Park; Byeong Doo Ko; Hun Gun Park, all of Kyungsangbook-Do, Rep. of Korea

[73] Assignee: Goldstar Co., Ltd., Rep. of Korea

[21] Appl. No.: 08/668,777

[22] Filed: Jun. 24, 1996

Related U.S. Application Data

[62] Division of application No. 08/309,396, Sep. 20, 1994, Pat. No. 5,569,391.

[30] Foreign Application Priority Data

Sep. 20, 1993 [KR] Rep. of Korea ..... 93-19070

[51] Int. Cl.[6] ..... H01J 9/02; H01J 9/18

[52] U.S. Cl. ..... 313/417; 313/337; 313/346 R; 313/446; 313/270; 24/25.15; 24/25.13; 216/33

[58] Field of Search ..... 313/417, 337, 313/346 R, 446, 270, 37

[56] References Cited

U.S. PATENT DOCUMENTS 4,170,811 10/1979 Turnbull ..... 29/25.16
4,210,988 7/1980 Turnbull et al. ..... 29/25.15

FOREIGN PATENT DOCUMENTS 56-73834 6/1981 Japan .

OTHER PUBLICATIONS

RCA Technical Notes, "One–Piece Bimetal Cathode Cup and Sleeve", John C. Turnbull, Princeton, NJ. Jul. 23, 1976 TN No. 1159 2 pages.

*Primary Examiner*—Sandra O'Shea
*Assistant Examiner*—Matthew J. Gerike
*Attorney, Agent, or Firm*—Ostrolenk, Faber, Gerb & Soffen, LLP

[57] ABSTRACT

An indirect cathode sleeve and manufacturing method thereof capable of substantially reducing electric power consumption of a heater disposed inside the cathode sleeve and simultaneously reducing a picture-producing time by oxidizing an inside surface of the cathode sleeve and reducing an outside surface thereof. The cathode sleeve includes a heater disposed inside the cathode sleeve; a base metal formed at the top of the cathode sleeve; an electron-emitting material layer formed at the outside surface of the base metal; and an indirect cathode sleeve including a black inside surface and a white outside surface. The method for manufacturing the indirect cathode sleeve includes the steps of forming a structure of a cathode sleeve consisting of a bimetal which consist of a Nickel-Chrome alloy at an inside surface of the cathode sleeve and a Nickel alloy at an outside surface of the cathode sleeve; oxidizing the inside surface of the cathode sleeve through a high temperature wet hydrogen environment; selectively etching the outside surface of the cathode sleeve and, as a result, forming a base metal at the top of the cathode sleeve; and forming an electron-emitting material layer at the outside surface of the base metal.

1 Claim, 7 Drawing Sheets

INDIRECT CATHODE SLEEVE

This is a division of application Ser. No. 08/309,396, filed Sep. 20, 1994, now issued as U.S. Pat. No. 5,569,391.

BACKGROUND OF THE INVENTION

1. Field of the Invention

The present invention relates in general to an indirect cathode sleeve and manufacturing method thereof, and more particularly to an indirect cathode sleeve and manufacturing method thereof capable of substantially reducing electric power consumption of a heater which is disposed inside the cathode sleeve and simultaneously reducing a picture-producing time by making an inside surface of the cathode sleeve oxidized and an outside surface thereof reduced.

2. Description of the Conventional Art

Conventionally, with reference to FIG. 1, a hollow cathode sleeve 2 which has the top closed, is shown. A cathode sleeve support 5 having a hollow and larger diameter than that of the cathode sleeve 2 surrounds the cathode sleeve 2, specially a predetermined upper and lower portions thereof are affixed to the outside surface of the cathode sleeve 2. A plurality of heaters 3 are disposed inside the cathode sleeve 2 and electrically connected with a power supply. A cap-shaped controlling electrode G1 is fixedly disposed above but not touching the top of the cathode sleeve 2 for controlling the on-off state of an electron beam which is generated at the cathode sleeve 2, additionally having a hole 7 disposed at the center portion thereof with a predetermined diameter for passing the electron beam. An upside down cap-shaped accelerating electrode G2 is fixedly disposed above but not touching the controlling electrode G1 for accelerating the electron beam, additionally having a hole 6 disposed at the center portion thereof with a predetermined diameter for passing the electron beam. Here, the outer edge of the accelerating electrode G2 is affixed to the body(not shown) of the cathode sleeve 2. A condensing electrode G3 is disposed above but not touching the accelerating electrode G2 for condensing the electron beam generated at the cathode sleeve 2 and affixed to the accelerating electrode G2, additionally having a hole 8 disposed at the center portion thereof with a predetermined diameter for condensing and passing the electron beam which is passed through the controlling electrode G1, the accelerating electrode G2 and the condensing electrode G3, in order.

The operation of the conventional cathode sleeve 2 will now be explained.

When electric power is applied to the heater 3, it becomes heated, and an electron beam is generated due to a chemical reaction between a base metal 1 and the electron-emitting material(not shown). The quantity of the electron beam generated is first controlled by the controlling electrode G1. The controlled electron beam enters into the accelerating electrode G2 through the hole 7. The electron beam that enters into the accelerating electrode G2 is accelerated thereby and passes the hole 8 and enters into the condensing electrode G3. Where the electron beam is condensed. With reference to FIG. 2A to FIG. 2C, the conventional bimetal type of indirect cathode sleeve and manufacturing methods thereof are shown.

Referring to FIG. 2A, the forming step of the conventional bimetal type of indirect cathode sleeve is shown. The Nickel alloy which is made of Nickel(key component), Magnesium, Silicon, and Tungsten used as a reducing components, is formed at the outside surface of the cathode sleeve. The Nickel-Chrome alloy 13 is formed at the inside surface of the cathode sleeve.

Referring to FIG. 2B, the etching step of the conventional bimetal type of indirect cathode sleeve is shown. Through the etching step, a predetermined outside surface of the cathode sleeve is unetched by masking it and the remaining surface is etched, that is, the surface unetched remains a bimetal type structure and then the surface etched remains a Nickel-Chrome alloy. In the drawings, reference numeral 22*o* denotes the outside surface of the cathode sleeve and 22*i* denotes the inside surface of the cathode sleeve.

To begin with, the etching step will now be explained.

The etching step is well known from U.S. Pat. Nos. 4,376,009 and 4,441,957. According to these patents, a predetermined surface of the top of the cathode sleeve 22 is completely masked with an acid-resistant material such as silicon rubber. A bar is inserted into the cathode sleeve 22 through the bottom thereof in order to sealingly prevent the inside surface of the cathode sleeve 22 from the etchant during etching. Thereafter, the etchant floods the cathode sleeve 22, so that the unmasked surface thereof is etched and the masked surface thereof is unetched. As a result, shown in FIG. 2B, the top of the cathode sleeve 22 appear as having a cap-shaped head.

With reference to FIG. 2C, a base metal 12*a* made of Nickel alloy is formed at the top of the cathode sleeve 22. An electron-emitting material layer 4 is formed at the outside surface of the base metal 12*a*. Here, the electron beam is generated from a chemical reaction between a metal 12*a* and the electron-emitting material 4.

However, studies on how to reduce the picture-producing time and decrease electric power consumption of the heater (not shown) have been conducted. Here, the picture-producing time denotes the time it takes from supplying power to the heater to producing an image onto the screen. As a result, another embodiment of the conventional indirect cathode sleeve and manufacturing method thereof is developed. As shown in FIGS. 3A to 3C, it is related to make an outside/inside surface of the cathode sleeve 22 oxidized, that is, to form the inside thereof black having a high heat radiating rate, whereby the picture-producing time and the heater consumption electric power are both reduced. Referring to FIG. 3A, the forming step is to form the inside surface of the cathode sleeve 23 with a Nickel-Chrome alloy and the outside surface of the cathode sleeve with a Nickel alloy. Here, the cathode sleeve 23 is a bimetal and has the top opened. A cap-shaped base metal 13*a* is formed at the top of the cathode sleeve 23. Referring to FIG. 3B, the heat process is to make the inside/outside surface of the cathode sleeve 23 oxidized by oxidizing the Chrome component which is included therein. Referring to FIG. 3C, an electron-emitting material layer 13*a* is formed at the outside surface of the base metal 13*a*.

Typically, the cathode sleeve made of the Nickel alloy should have a dew point of the heat process hydrogen of over −40° C., where the Chrome is oxidized. At this time, the state of the cathode sleeve is called an oxidizing state. The level of the oxidization of the cathode sleeve is greatly based on the dew point of the heat process hydrogen. That is, strong oxidization is achieved as the dew point of the heat process hydrogen is high, so that the heat radiating rate become high and thus the picture-producing time becomes quicker. However, if overoxidiazation is conducted, the base metal is simultaneously oxidized, so that the desired effects of the oxidization is reduced due to heat damages. In this case, as shown in FIG. 1, the welding step cannot be conducted at the portion where the cathode sleeve 2 is welded to the cathode sleeve support 5 due to the oxidization of the Chrome at the outside surface of the cathode sleeve 2.

On the contrary, in case that the dew point of the heat process hydrogen is low in a high temperature hydrogen environment, resistance welding is possible between the cathode sleeve 2 and the cathode sleeve support 5, so that the electric power consumption of the heater 3 will be reduced. However, if the oxidization condition of the cathode sleeve 2 is weak and the heat radiating rate is low, consequently the improvement of the picture-producing time cannot basically be achieved.

In addition, in order to make the cathode sleeve 22 be equipped with the oxidization state having the best heat radiating rate, the dew point of the heat process hydrogen in the high temperature wet process environment should be over 0° C., in addition, the dew point of the heat process hydrogen in the high temperature wet process environment in order to prevent the electron-producing characteristics from heat damage by the oxidization of the base metal should be below 20° C. In case that the dew point of the heat process hydrogen is between 0° C. and 20° C., the heat radiating rate should maintain 80%. In addition, in case that the dew point of the heat process hydrogen is below −40° C., the heat radiating rate increases four times, and in addition the picture-producing time is reduced by 2 seconds.

However, if the cathode sleeve 22 is oxidized in a state that the heat radiating rate is high, as previously noted, the resistance welding properties become poor.

With reference to FIG. 2, since the dew point of the heat process hydrogen of the conventional bimetal type of the indirect cathode sleeve is between −35° C. and −25° C., both the outside and inside surface of the cathode sleeve 22 are oxidized, but in case the level of the oxidization condition is low, even though the resistance welding is possible between the cathode sleeve 22 and the cathode sleeve support 5, increasing the picture-producing time is difficult because the heat radiating rate is below 40%.

To resolve the problems of the conventional bimetal type of the indirect cathode sleeve as shown in FIG. 2, another embodiment of the cathode sleeve as shown in FIG. 3 is well known. The conventional cathode sleeve with the top opened is made of a Nickel-Chrome alloy inside and a Nickel alloy outside. Thereafter, the top thereof is formed with a cap-shaped base metal 13*a*. The inside surface thereof is oxidized and the outside is reduced, leaving the inside black and the outside white. In this case, even though the desired effects of getting a high heat radiating rate inside and a low heat radiating rate outside as well as a rapid picture-producing time are achieved, the cathode sleeve is thicker, thus the manufacturing costs is high and the manufacturing time will be prolonged due to its complicated structure. In the conventional cathode sleeve, when making the cathode sleeve thinner, during a high temperature process, the structure of the cathode sleeve will be changed in its size and appearance.

SUMMARY OF THE INVENTION

Accordingly, it is an object of the present invention to provide an indirect cathode sleeve and manufacturing method thereof by making an inside surface thereof oxidized, that is, black, in order to achieve a high heat radiating property therein and an outside surface thereof reduced, that is, white, in order to achieve a low heat radiating property.

To achieve the object, the apparatus of the present invention includes a cathode sleeve, made of one sheet metal plate, with a heater therein; a base metal formed at the top of the cathode sleeve; and an electron-emitting material layer formed at the outside surface of the base metal.

In addition, the cathode sleeve according to the present invention includes a heater disposed inside the cathode sleeve; a base metal formed at the top of cathode sleeve; an electron-emitting material layer formed at the outside surface of the base metal; and an indirect cathode sleeve including a black inside surface thereof and a white outside surface thereof.

The method for manufacturing an indirect cathode sleeve includes the steps of forming a structure of a cathode sleeve consisting of a bimetal which consist of a Nickel-Chrome alloy at an inside surface of the cathode sleeve and a Nickel alloy at an outside surface of the cathode sleeve; oxidizing the inside surface of the cathode sleeve through a high temperature wet hydrogen environment; selectively etching the outside surface of the cathode sleeve, as a result, forming a base metal at the top of the cathode sleeve; and forming an electron-emitting material layer at the outside surface of the base metal.

BRIEF DESCRIPTION OF THE DRAWINGS

The objects and features of the invention may be more readily understood with reference to the following detailed description of an illustrative embodiment of the invention, taken together with the accompanying drawings in which.

DESCRIPTION OF THE PREFERRED EMBODIMENTS

Figure 1:
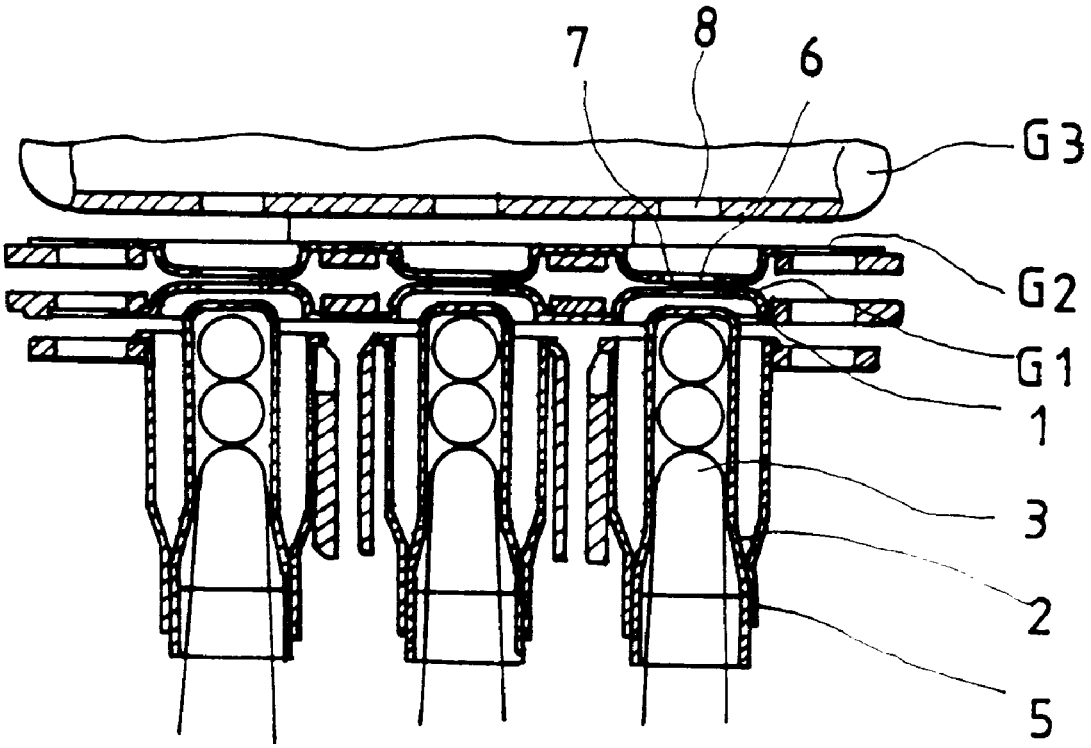
FIG.1 CONVENTIONAL ART
FIG. 1 is a cross-sectional view showing a cathode sleeve for a conventional electron tube.
Figure 2A:
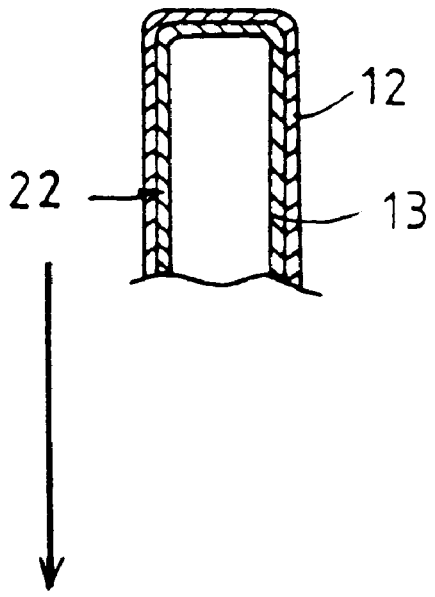
FIG. 2A CONVENTIONAL ART
FIGS. 2A to 2C are illustrative views showing a forming step of a conventions cathode sleeve.
Figure 2B:
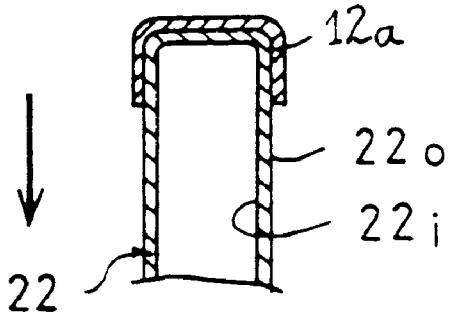
FIG. 2B CONVENTIONAL ART
Figure 2C:
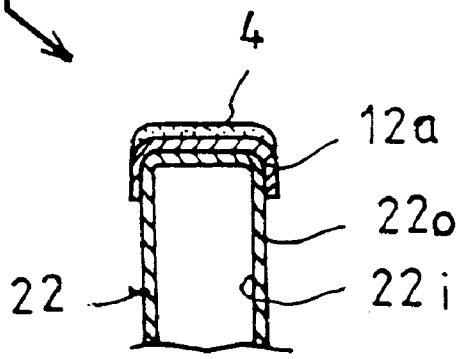
FIG. 2C CONVENTIONAL ART
Figure 3A:
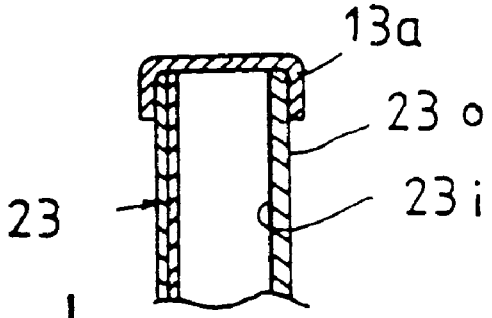
FIG. 3A CONVENTIONAL ART
FIGS. 3A to 3C are illustrative views showing a forming step according to another embodiment of a conventional cathode sleeve.
Figure 3B:
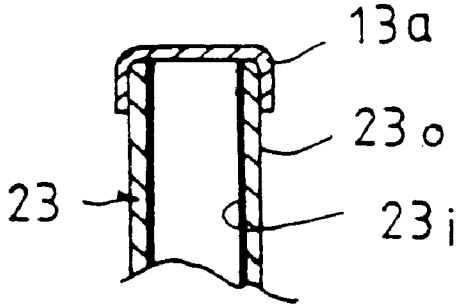
FIG. 3B CONVENTIONAL ART
Figure 3C:
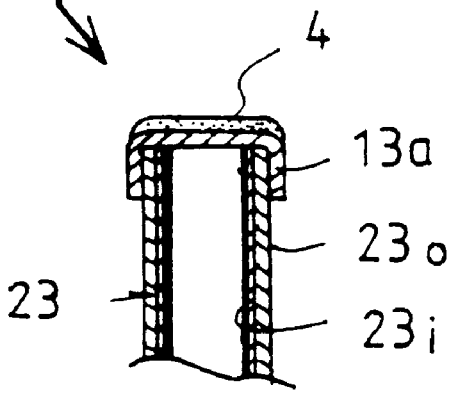
FIG. 3C CONVENTIONAL ART
Figure 4A:
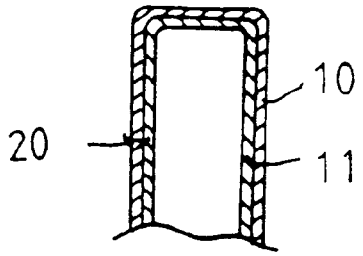
FIGS. 4A–4D are views showing structures and forming steps of a cathode sleeve according to an embodiment of the present invention.
Figure 4B:
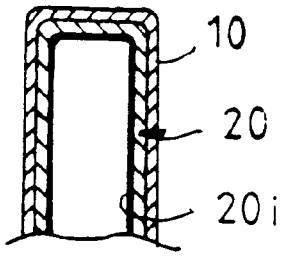
Figure 4C:
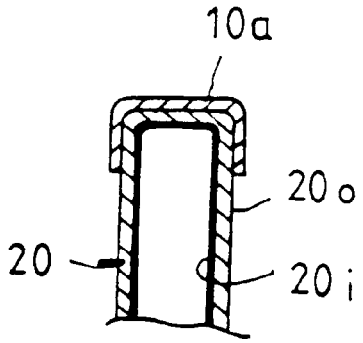
Figure 4D:
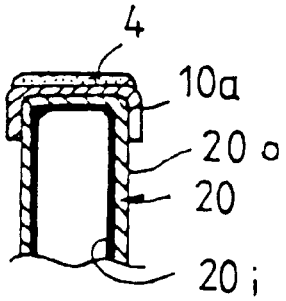

With reference to FIGS. 4A to 4C, a bimetal type of the indirect cathode sleeve and manufacturing method thereof according to an embodiment of the present invention is shown. To begin with, FIG. 4A shows a forming step of making the bimetal type cathode sleeve. Here, the cathode sleeve is made of a Nickel-Chrome alloy thereinside and a Nickel alloy including a very small amount of Magnesium or Silicon or Tungsten there outside. FIG. 4B shows a heat process of oxidizing the Chrome components contained in the Nickel-Chrome alloy and then making the inside surface thereof black. FIG. 4C shows an etching step of etching the unmasked surface of the Nickel alloy, leaving the masked portion unetched, so that a cap-shaped head of the cathode sleeve 20 appears. FIG. 4D shows the cathode sleeve 20 with a base metal 10*a* formed at the top of the cathode sleeve 20. In addition, the electron-emitting material layer 4 is formed at the outside surface of the base metal 10*a*.

In manufacturing the cathode sleeve described above, the heat process temperature is preferred to be below 1,100° C. and the dew point of the heat process hydrogen is preferred to be between 0° C. and 20° C.

In addition, after etching the cathode sleeve, it is preferred to reduce the outside surface of the cathode sleeve, so that the outside surface of the cathode sleeve becomes white.

The heat process temperature in the reducing step should be lower than that of the oxidizing step, thereby preventing the oxidized inside surface of the cathode sleeve 20 to be reduced. In order to prevent such reduction problems, the dew point of the heat process should preferably be below 0° C.

Figure 5A:
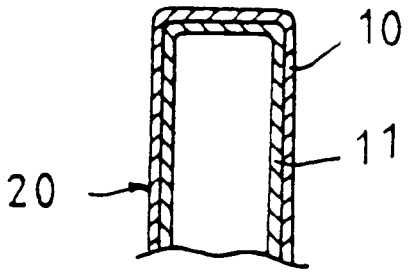
FIGS. 5A–5D are views showing structures forming steps of a cathode sleeve according to another embodiment of the present invention.
Figure 5B:
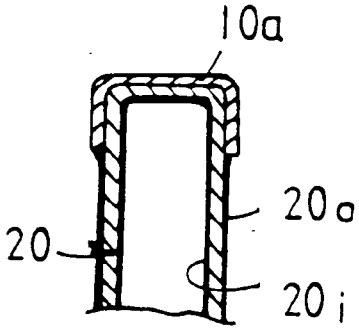

FIGS. 5A to 5D show a forming step according to another embodiment of the present invention. FIG. 5A shows a forming step where the inside surface of the cathode sleeve 20 is formed with a Nickel-Chrome alloy 11 containing Nickel and Chrome as key components and the outside of the cathode sleeve 20 is formed with a Nickel alloy 10 containing Nickel as a key component. Referring to FIG. 5B, an etching and heat process are shown. The etching step is referred to etch the unmasked surface of the inside and outside of the cathode sleeve 20 and not to etch the surface of the cathode sleeve 20, which is masked with an acid-resistance material such as a silicon rubber, so that the unmasked inside and outside surfaces of the cathode sleeve 20 are etched by flooding the etchant onto the etching desired surface thereof. Thereafter, the heat process is conducted to the inside and outside surface of the cathode sleeve 20 for oxidizing the Chrome components contained in the cathode sleeve 20 in the high temperature dry hydrogen environment, so that the inside and outside surfaces of the cathode sleeve 20 become black. Next, the masking materials are removed.

Figure 5C:
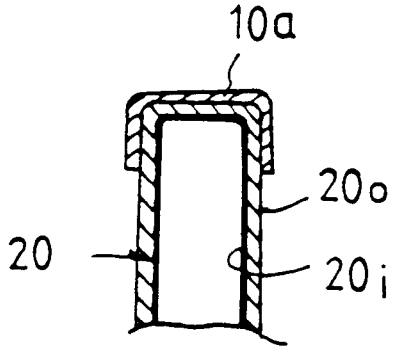

Referring to FIG. 5C, the heat process for reducing the oxidized outside surface of the cathode sleeve 20 is shown. It is required to minimize the reducing step at the inside surface of the cathode sleeve 20 and to maximize the reducing step at the outside surface of cathode sleeve 20. The heat process temperature at the reducing step should be lower than that of the oxidizing step. The dew point of the heat process hydrogen at the reducing step should be below −40° C. in order to reduce the oxidized outside surface of the cathode sleeve 20.

Figure 5D:
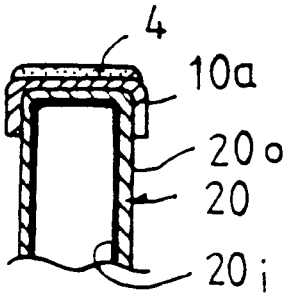

After the heat process are completed, as shown in FIG. 5D, the electron-emitting material layer 4 is formed at the outside surface of the base metal 10*a*.

With reference to FIGS. 6A to 6D, another embodiment of the indirect cathode sleeve and manufacturing method thereof according to the present invention is shown.

Figure 6A:
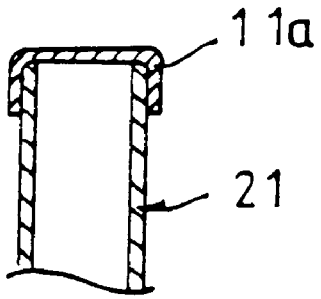
FIGS. 6A–6D are views showing structures and forming steps of a cathode sleeve according to still another embodiment of the present invention.
Figure 6B:
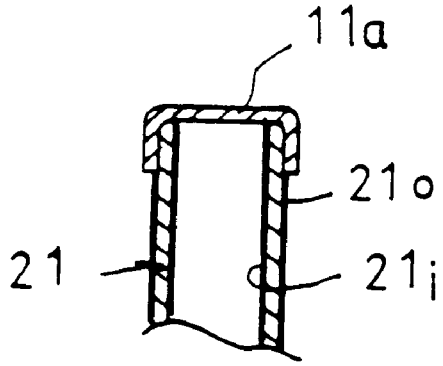
Figure 6C:
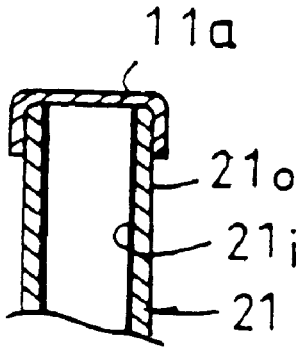
Figure 6D:
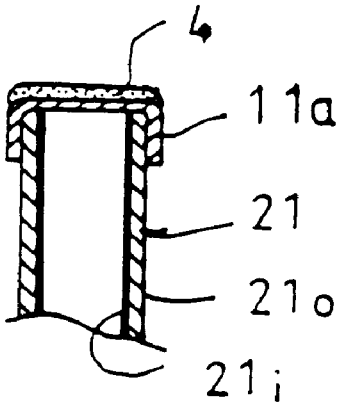

Referring to FIG. 6A, the present invention includes the processes of welding the base metal 11 made of the Nickel alloy at the top of the cathode sleeve 21 made of the Nickel-Chrome alloy, which has the top opened; oxidizing the inside and outside surface of the cathode sleeve 21, which contains the Chrome components, in the high temperature wet hydrogen environment; reducing the outside surface of the cathode sleeve 21; and forming the electron-emitting materials layer 4 at the outside surface of the base metal 11*a*.

Figure 7:
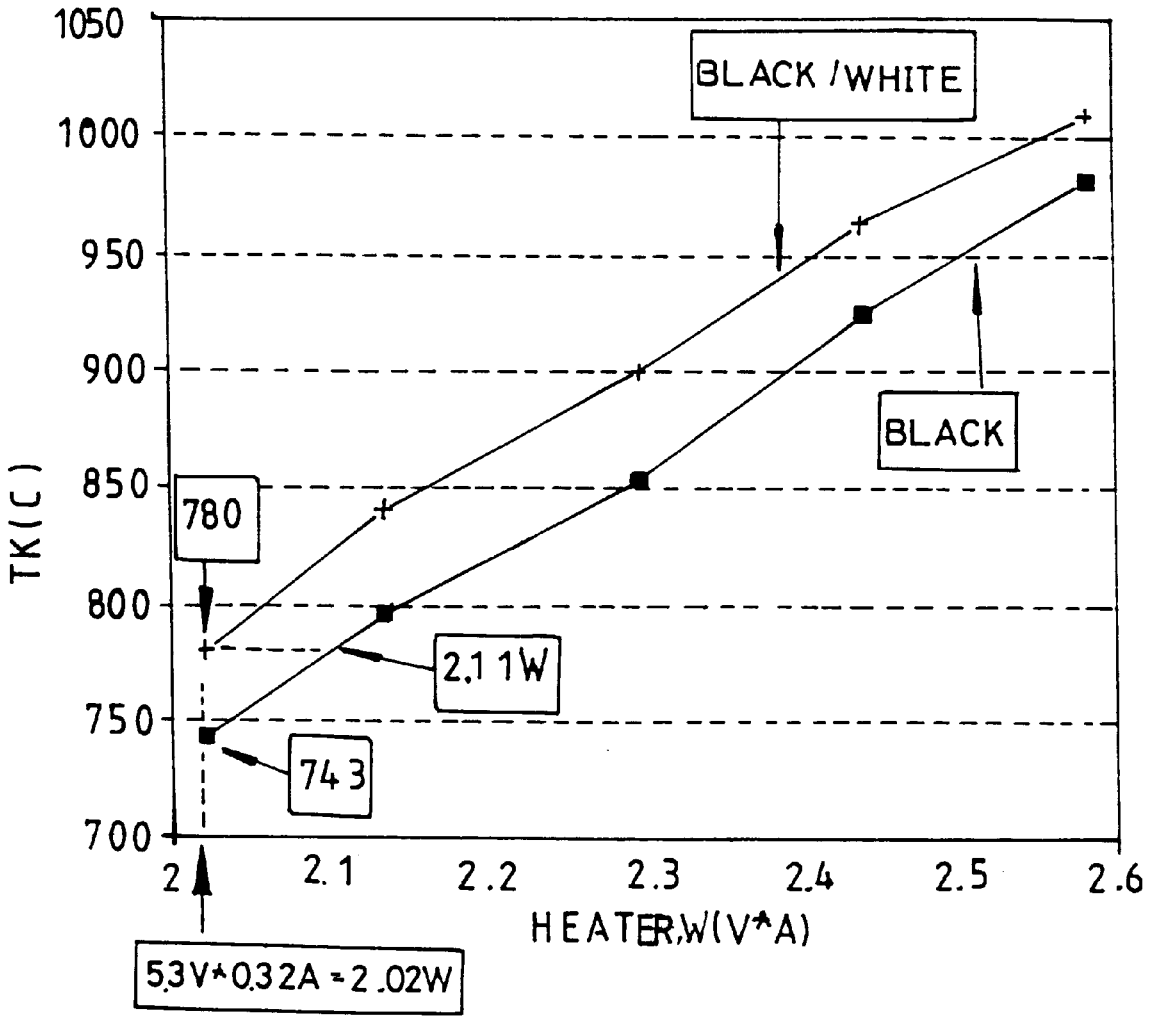
FIG. 7 is a graph showing a comparison between the heater consumption power and the cathode sleeve temperature of the cathode sleeve according to the present invention and that of the conventional cathode sleeve equipped with the inside and outside surface of the cathode sleeve, both surfaces of which are oxidized.

With reference to FIG. 7, a graph showing a comparison between the heater power consumption power and the temperature according to the present invention and that of the conventional cathode sleeve equipped is shown.

In this oxidizing step according to the present invention, the heat process temperature is preferred to be below 1,100° C. and the dew point of the heat process is preferred to be between 0° C. and 20° C. In addition, it is required to minimize the reducing step at the inside surface of the cathode sleeve and to maximize the reducing step at the outside surface of cathode sleeve. The heat process temperature at the reducing step should be lower than that of the oxidizing step. The dew point of the heat process hydrogen at the reducing step should be below −40° C. in order to reduce the oxidized outside surface of the cathode sleeve.

The effects of the indirect cathode sleeve and manufacturing method thereof according to the present invention will now be explained.

By making the inside surface of the cathode sleeve black by oxidizing the surface containing the Chrome component and the outside surface of the cathode sleeve white by reducing the oxidized surface, the indirect cathode sleeve can achieve a high heat radiating efficiency inside and a low heat radiating efficiency outside, so that the picture-producing time will be reduced and the heater consumption power will also be reduced. In addition, by making the cathode sleeve have a desired thickness, welding the cathode sleeve to the cathode sleeve support will be possible.

What is claimed is:

1. An indirect cathode sleeve, made of mono-metal plate and as a one sheet structure sleeve, with a heater therein, the indirect cathode sleeve comprising:

a separate, cap shaped base metal formed at a top of the indirect cathode sleeve; and an electron-emitting material layer formed at an outside surface of the base metal, a highly absorptive surface being formed on an inner surface of the indirect cathode sleeve by an oxidation reaction applied thereto and a low heat radiation metal gloss outside surface being formed on an outer surface of the indirect cathode sleeve by a reduction reaction applied thereto, said sleeve consisting of a nickel-chrome alloy.

* * * * *